US006561391B1

(12) United States Patent
Baker

(10) Patent No.: US 6,561,391 B1
(45) Date of Patent: May 13, 2003

(54) DISPENSER PACKAGE

(75) Inventor: Paul Joseph Baker, Saylorsburg, PA (US)

(73) Assignee: Mars, Incorporated, McLean, VA (US)

( * ) Notice: Subject to any disclaimer, the term of this patent is extended or adjusted under 35 U.S.C. 154(b) by 0 days.

(21) Appl. No.: 10/026,885

(22) Filed: Dec. 27, 2001

(51) Int. Cl.[7] ..... B65D 47/00

(52) U.S. Cl. ..... 222/556; 220/15; 220/63; D32/37

(58) Field of Search ..... 222/562, 556; 220/15, 63; D7/392, 392.1; D9/449; D32/37

(56) References Cited

U.S. PATENT DOCUMENTS 3,760,972 A * 9/1973 McKirnan ..... 220/15
D329,929 S * 9/1992 Knoedler et al. ..... D32/37
5,273,177 A * 12/1993 Campbell ..... 222/562
D356,499 S * 3/1995 Cautereels et al. ..... D9/449
D372,866 S * 8/1996 Ahern, Jr. ..... D9/449
D393,569 S * 4/1998 Lai et al. ..... D7/392

* cited by examiner

*Primary Examiner*—Gene Mancene
*Assistant Examiner*—Melvin A Cartagena
(74) *Attorney, Agent, or Firm*—Fitzpatrick, Cella, Harper & Scinto

(57) ABSTRACT

A dispenser package having a cap and a hollow container, where the container defining an interior volume and a top opening, and the cap has a plurality of sides and a flap. The sides of the cap define a dispensing aperture, and the flap is attached to at least one of the sides by a hinge. The flap has a closed position in which the flap covers the dispensing aperture and an open position to provide access to the container interior volume through the dispensing aperture and the container top opening. At least two of the sides of the cap comprise upper edges having a convex arcuate shape, and the flap has an arcuate shape corresponding to the arcuate shape of the side upper edges.

19 Claims, 2 Drawing Sheets

DISPENSER PACKAGE

BACKGROUND OF THE INVENTION

1. Field of the Invention

The present invention generally relates to a dispenser for small objects, such as candy, pills, tablets, and other objects of similar size. In particular, the present invention relates to a dispenser having a shallow dome shaped cap, having an aperture that allow the contents of the dispenser to freely flow when the open dispenser is tipped.

2. Related Background Art

Dispensers for small objects, such as candy, pills, tablets, and other objects of similar size are well known in the art. Such dispensers, especially those used for candy, typically comprise a hollow body and a separately formed top portion. Typically, the hollow body has a sealed base and an open top. The top portion has a flat top surface in which at least one aperture is formed in just a portion of the surface. As the aperture is formed in only a portion of the top surface, access into the dispenser may be limited. A closure element or flap forms a portion of the flat top surface, and covers the aperture when closed. The closure element may be opened to allow allows access through the aperture to objects within the hollow body, and may be closed to secure objects within the hollow body. Both the hollow body and the top portion are typically formed by injection molding or a similar molding process known in the art. The hollow body is typically formed from a relatively rigid, transparent plastic, such as, e.g., polystyrene, and the top portion is formed from a relatively flexible plastic, such as, e.g., polyvinyl chloride.

The hollow body typically has the general shape of a right rectangular prism, such that the base and top opening of the hollow body are generally rectangular in shape. The top portion has a shape corresponding to the top opening of the body, such that the top portion can be inserted into or placed over the open end of the hollow portion in such a manner that the top portion and the hollow body each securely grip the other. This allows the dispenser to be securely closed when the closure element is closed.

The closure element of known dispensers, typically comprises a generally rectangular flap that covers the aperture. The flap generally is hinged at one end of the aperture near the middle of the top portion, and is configured to securely engage the top portion at the other end of the aperture, near the edge of the top portion, when closed.

For example, U.S. Pat. No. 4,538,731 to Cillario discloses a generally rectangular dispenser of the type discussed above in which the closure element is configured to reduce the amount of force required to open the closure to obtain access to the objects within the container. The dispenser can be opened with one hand by holding the dispenser in the palm of one hand and pushing up on the flap with the thumb, or with two hands by holding the dispenser in one hand, and lifting the flap with the fingers of the other hand.

Similarly, U.S. Pat. No. 5,636,732 to Gilels et al, discloses a cap for a package of chewing gum. The cap is placed on the open end of the rectangular hollow body of the package, and has a frame that surrounds the open end and a pair of hinged covers that are opened to gain access to the gum within the package through a pair of apertures.

U.S. Pat. No. 4,144,985 to Kinslow discloses a dispenser comprising a substantially rectangular container and a plug that is placed in the open mouth of the container. The plug has a top wall with an opening that is closed with a hinged flap integral with the top wall. The flap is secured by a snap-action provided by the free end of the flap and the top wall.

U.S. Pat. No. 4,095,712 to Perrella discloses a generally rectangular dispenser comprising a hollow body and a lid for closing the opening to the hollow body in the manner of a slip-on lid. The use of two separate parts facilitates the filling of the dispenser. However, the disclosed dispenser may be formed as a single piece. The lid comprises a delivery aperture, surrounded on three sides by a support and arresting rib on which a flap closure element rests when the dispenser is closed. Three sides of the flap are free of what is referred to as the "upper base" of the lid, and the fourth side of the lid is rigidly connected to the rest of the upper base. To insure the rigidity of the connection, a stiffening rib is added on the underside of the lid and upper base. The remaining portion of the upper base that does not form the flap is formed in one piece with the lid, and is beveled on at least three sides in the form of a truncated pyramid, in which the upper or minor base provides the surface on which pressure is applied to open the flap. Subjecting the minor base of the truncated pyramid distorts the lid, forcing the flap open. Releasing the pressure allows the truncated pyramid to return to its original form, closing the flap.

The apertures of known dispensers are typically significantly smaller than the top of the dispenser, which restricts the flow of the contents when the dispenser is tipped. Therefore, a need exists for a dispenser having an aperture that is substantially the same size as the dispenser top to provide a sufficient flow. The present invention provides such a dispenser.

SUMMARY OF THE INVENTION

The present invention is directed to a dispenser package that comprises a cap and a hollow container. The container defines an interior volume and a top opening. The cap comprises flap and a plurality of sides, which define a dispensing aperture. Preferably, when the dispenser package of the invention is held upright, the sides are generally vertical. The flap is attached to at least one of the sides by a hinge, which is preferably is a living hinge. The flap has a closed position in which the flap covers the dispensing aperture and an open position to provide access to the container interior volume through the dispensing aperture and the container top opening.

At least two of the sides comprise upper edges having a convex arcuate shape, and the flap has an arcuate shape corresponding to the arcuate shape of the side upper edges. Preferably, the cap comprises two long sides, having the arcuate shaped upper edges, and two short sides connecting the long sides, and wherein the flap is attached to one of the short sides. The shape and size of the flap and the aperture, which form substantially the entire tope surface of the cap, allow the contents of the dispenser to flow freely when the flap is opened, and the dispenser is tipped.

DETAILED DESCRIPTION

The present invention is directed to a dispenser or package for pieces of candy or other objects of similar size, including, but not limited to pills, tablets, and small electrical or mechanical parts, e.g., screws, nuts, bolts, and resistors.

Figure 2:
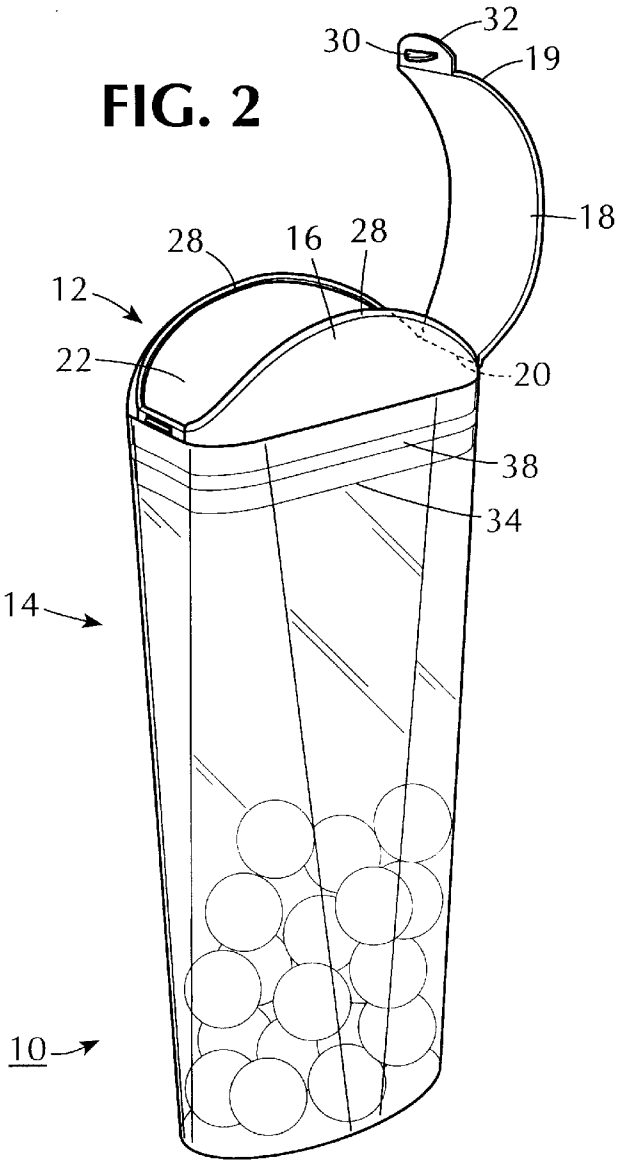
FIG. 2 illustrates a dispenser of the invention with the flap in the open position.
Figure 1:
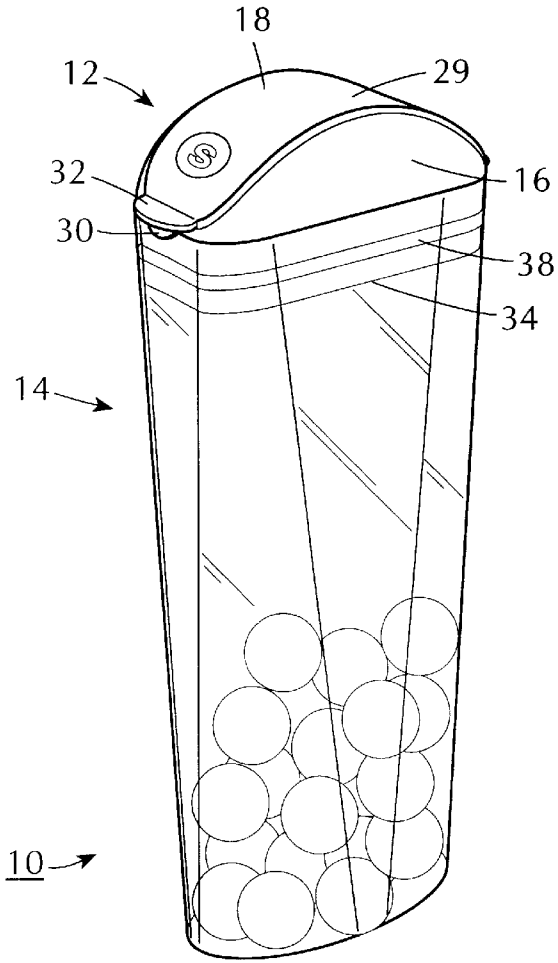
FIG. 1 illustrates a dispenser of the invention with the flap in the closed position.

A dispenser of the invention is illustrated generally in FIGS. 1 and 2. Dispenser 10 comprises a cap 12 and a container 14. Cap 12 comprises a plurality of sides 16 and a flap 18, which is attached to one of sides 16 by a hinge 20, and has a free end 19. Free end 19 is preferably configured to grip one of the sides in the closed position, thereby securely covering the dispensing aperture. Preferably, hinge 20 is a "living" hinge; i.e., a hinge provided by forming that portion of cap 12 that connects flap 18 to one of sides 16 with a reduced cross section or thickness. However, any other useful type of hinge known in the art may be used in the invention. The sides 16 define a dispensing aperture 22 which allows access to objects within container 14 through cap 12 when flap 18 is in an open position.

At least two of sides 16 have an upper edge 28 having a convex arcuate shape. Flap 18 is also curved, and has an arcuate shape that corresponds to that of upper edges 28, such that, when flap 18 is closed to secure aperture 22, flap 18 lies on or between arcuate shaped upper edges 28 to give cap 12 at least a partial dome shape 29.

Figure 3A:
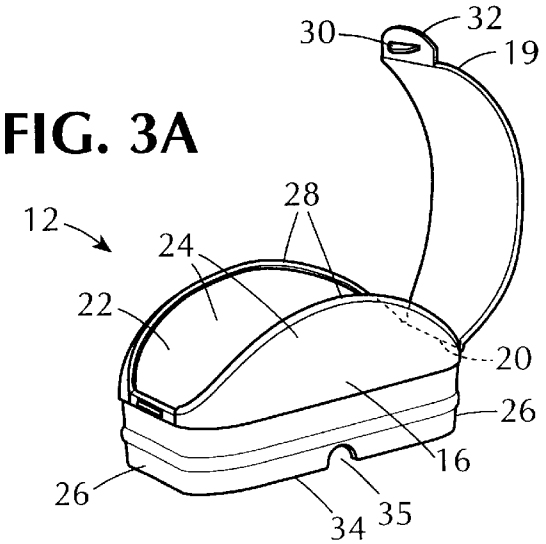
FIGS. 3*a* and 3*b* illustrate a cap of the dispenser of the invention in the open and closed positions.
Figure 3B:
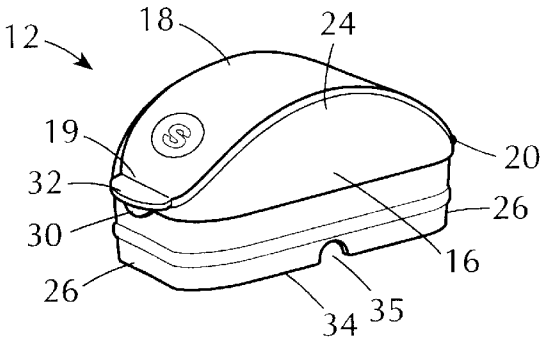

In a preferred embodiment, as illustrated in FIGS. 3*a* and 3*b*, cap 12 comprises two long sides 24, having arcuate shape upper edges 28, and two short sides 26, where short sides 26 connect long side 24 to provide an aperture 22 having a generally rectangular shape. Any of the sides may be flat or curved or may be generally flat in one portion, and curved where one side meets another side. Flap 18, when viewed above or below in projection, will have a shape that is substantially the same as that of aperture 22.

Flap 18 preferably has a latch 30 to secure flap 18 closed when pressed into the closed position. Latch 30 should open or close easily with a light finger pressure, but should also hold flap 18 firmly closed when dispenser 10 is shaken upside down or dropped a small distance. To aid opening of flap 18, flap 18 preferably includes a thumb tab 32.

Preferably, cap 12 further comprises a skirt 34 for attachment to container 14, the top of which defines an upper opening 36. In one embodiment, as illustrated in FIGS. 1 and 2, skirt 34 is inserted into opening 36. In an alternate embodiment, skirt 34 may be placed over container opening 36. Preferably, container 14 and cap 12 are configured to provide a snap fit, such as with a tongue and groove joint 38 formed from at least one groove or a ridge in each of skirt 34 and container 14. Preferably, the cap and the container are symmetrical, such that the cap and container may be attached in at least two different orientations to form the container. Most preferably, the cap and container may be attached in two different orientations that are about 180° apart. Where the cap and container may be attached in at least two different orientations to form the container, and different labels are used on opposite sides of the dispenser package, the cap may comprise a notch 35 in any one of sides 16 to orient the orientation of the flap to the labels.

Figure 4:
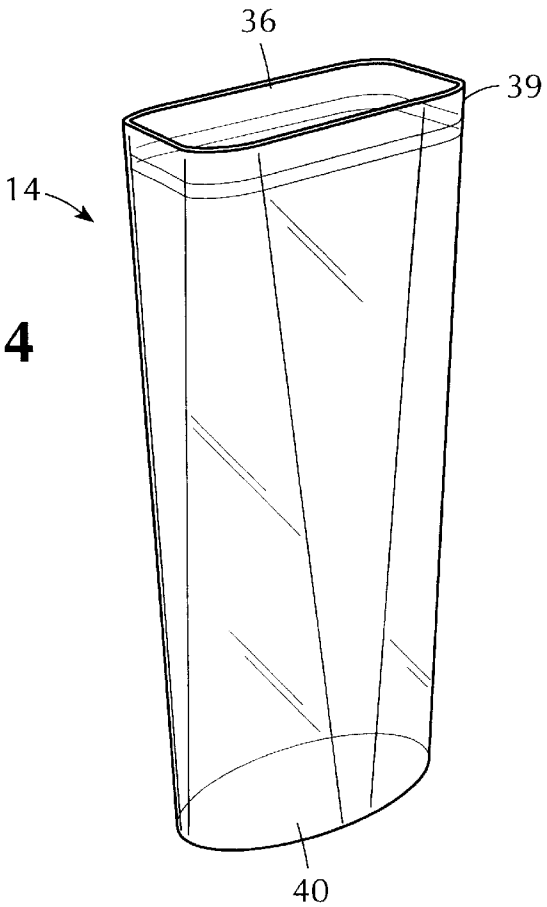
FIG. 4 illustrates a container of the dispenser of the invention.

Container 14 may have any useful shape, but is preferably shaped to fit comfortably in a consumer's hand, allowing the consumer to open and close the flap with finger pressure. As illustrated in FIG. 4, container 14 has a top opening 36, as described above, and a sealed base 40, which is most preferably oval in shape. When base 40 is oval, and container opening 36 is substantially rectangular, the container is tapered, so that the cross section of the container gradually changes from rectangular to oval or ellipsoidal from the top of the container 39 to base 40.

Cap 12 and container 14 of dispenser 10 are preferably formed by injection molding a plastic material, such as, e.g., polypropylene. The injection molding of the container may be performed, e.g., in a typical open and shut 32 cavity hot runner injection mold.

The cap is preferably molded in the open position in a 32 cavity hot runner injection mold with a lift slide for the undercut for the latch. The flap should be closed within about 15 minutes after the ejection to set the "living" hinge. The cap and container are preferably assembled after the container is filled with product to provide the finished dispenser.

This invention is not limited by the embodiments disclosed herein and it will be appreciated that numerous modifications and embodiments may be devised by those skilled in the art. Therefore, it is intended that the appended claims cover all such modifications and embodiments that fall within the true spirit and scope of the present invention.

What is claimed is:

1. A dispenser package, comprising;

a cap and a hollow container, the container defining an interior volume and a top opening;

the cap comprising a plurality of sides and a flap, the sides defining a dispensing aperture, wherein the flap is attached to at least one of the sides by a hinge, and the flap has a closed position in which the flap covers the dispensing aperture and an open position to provide access to the container interior volume through the dispensing aperture and the container top opening; wherein at least two of the sides comprise upper edges having a convex arcuate shape, and the flap has an arcuate shape corresponding to the arcuate shape of the side upper edges; and wherein the base of the container has a ellipsoidal shape; or at least a portion of the sides of the cap are generally vertical and substantially flat, or the base has a ellipsoidal shape, and at least a portion of the sides of the cap are generally vertical and substantially flat.

2. The dispenser package of claim 1, wherein the hinge is a living hinge.

3. The dispenser package of claim 1, wherein the cap comprises two long sides, having the arcuate shaped upper edges, and two short sides connecting the long sides, and the flap is attached to one of the short sides.

4. The dispenser container of claim 1, wherein the cap further comprises a notch in a lower edge of one of the sides.

5. The dispenser of claim 1, wherein the flap comprises a free end configured to grip one of the sides in the closed position, thereby securely covering the dispensing aperture.

6. The dispenser of claim 1, wherein the sides having the arcuate shaped edges are generally flat, such that the cap has a partial dome shape when the flap is closed.

7. The dispenser of claim 1, wherein the container comprises an open end, and the cap comprises a skirt configured to be inserted into the container opening.

8. The dispenser of claim 7, wherein the container opening and the cap skirt each comprise at least one of a groove or a ridge, configured to provide a snap-fit between the cap and the container.

9. The dispenser of claim 1, wherein the cap and the container are symmetrical, such that the cap and container may be attached in at least two different orientations to form the container.

10. The dispenser of claim 1, wherein the cap and the container are symmetrical, such that the cap and container may be attached in two different orientations that are about 180° apart.

11. A dispenser package, comprising;

a cap and a hollow container, the container defining an interior volume and a top opening;

the cap comprising a plurality of sides, a flap, and a skirt, the sides defining a dispensing aperture, wherein the flap is attached to at least one of the sides by a hinge, the flap has a closed position in which the flap covers the dispensing aperture and an open position to provide access to the container interior volume through the dispensing aperture and the container top opening; and the skirt is configured to be inserted into the top opening of the container; and wherein at least two of the sides comprise upper edges having a convex arcuate shape, and the flap has an arcuate shape corresponding to the arcuate shape of the side upper edges.

12. The dispenser package of claim 11, wherein the hinge is a living hinge.

13. The dispenser package of claim 11, wherein the cap comprises two long sides, having the arcuate shaped upper edges, and two short sides connecting the long sides, and the flap is attached to one of the short sides.

14. The dispenser container of claim 11, wherein the cap comprises a notch in a lower edge of one of the sides.

15. The dispenser of claim 11, wherein the flap comprises a free end configured to grip one of the sides in the closed position, thereby securely covering the dispensing aperture.

16. The dispenser of claim 11, wherein the sides having the arcuate shaped edges are generally flat, such that the cap has a partial dome shape when the flap is closed.

17. The dispenser of claim 11, wherein the container opening and the cap skirt each comprise at least one of a groove or a ridge, configured to provide a snap-fit between the cap and the container.

18. The dispenser of claim 11, wherein the cap and the container are symmetrical, such that the cap and container may be attached in at least two different orientations to form the container.

19. The dispenser of claim 11, wherein the cap and the container are symmetrical, such that the cap and container may be attached in two different orientations that are about 180° apart.

* * * * *